US012084092B1

(12) United States Patent
Sleadd

(10) Patent No.: US 12,084,092 B1
(45) Date of Patent: Sep. 10, 2024

(54) AUTO-RETURN ZIP LINE TROLLEY SYSTEM

(71) Applicant: Nathan Graham Sleadd, Grants Pass, OR (US)

(72) Inventor: Nathan Graham Sleadd, Grants Pass, OR (US)

( * ) Notice: Subject to any disclaimer, the term of this patent is extended or adjusted under 35 U.S.C. 154(b) by 684 days.

(21) Appl. No.: 17/397,483

(22) Filed: Aug. 9, 2021

Related U.S. Application Data

(60) Provisional application No. 63/210,125, filed on Jun. 14, 2021.

(51) Int. Cl.
*B61B 3/02* (2006.01)
*A63G 21/22* (2006.01)
*B61B 7/06* (2006.01)

(52) U.S. Cl.
CPC ..... *B61B 3/02* (2013.01); *A63G 21/22* (2013.01); *B61B 7/06* (2013.01)

(58) Field of Classification Search
CPC ..... B61B 3/02; B61B 7/06; A63G 21/22
See application file for complete search history.

(56) References Cited

U.S. PATENT DOCUMENTS 3,405,651 A * 10/1968 Harmon ..... B61B 11/00 104/173.2
3,498,236 A * 3/1970 Meek ..... B61B 7/06 105/51
4,492,168 A * 1/1985 Cellai ..... B61B 12/02 105/153
7,624,684 B2 12/2009 Morris
7,966,940 B2 * 6/2011 Cylvick ..... B61B 7/02 104/115
8,393,277 B2 * 3/2013 Johnston ..... B61B 3/02 104/238
9,579,578 B2 * 2/2017 Chasteen ..... A63G 21/22
2002/0162477 A1 11/2002 Palumbo

* cited by examiner

*Primary Examiner* — Scott A Browne
(74) *Attorney, Agent, or Firm* — Jerry Haynes Law

(57) ABSTRACT

An auto-return zip line trolley provides a vehicle that rides a suspended cable between a low point and a high point. The vehicle is urged along the cable by a remote-controlled drive wheel. A motor drives the drive wheel to roll along the cable, when engaged. When a load is applied to the vehicle, a spring-loaded sheave subassembly urges the cable away from the drive wheel, such that the vehicle rides freely from a high point to a low point on the cable. When the load is removed from the vehicle, the spring-loaded sheave subassembly urges the cable into engagement with the drive wheel to enable motor-powered propulsion of the vehicle from the low point to the high point of cable. A receiver inside the housing is in operational communication with the motor. A transmitter transmits a control signal to the receiver for regulating power and speed of the motor.

20 Claims, 4 Drawing Sheets

AUTO-RETURN ZIP LINE TROLLEY SYSTEM

CROSS-REFERENCE TO RELATED APPLICATIONS

This application claims the benefits of U.S. provisional application No. 63/210,125 filed Jun. 14, 2021, and entitled AUTO-RETURN ZIP LINE TROLLEY SYSTEM, which provisional application is incorporated by reference herein in its entirety.

FIELD OF THE INVENTION

The present invention relates generally to an auto-return zip line trolley assembly. More so, the present invention relates to a vehicle that rides a suspended cable and is powered by a remote-controlled drive wheel that disengages the cable when a load is carried, such that the vehicle rides freely from a high point to a low point on the cable; and the drive wheel re-engages the cable when the load is removed to enable motor-powered propulsion of the vehicle from the low point to the high point of the cable.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Generally, a zip line consists of a trolley movably suspended on a cable that is erected over an inclined area. It is designed to enable a user to be propelled by gravity to travel from the top to the bottom of the inclined cable by holding on to, or attaching to, the freely moving trolley. Zip-lines come in many forms, most often used as a means of entertainment. They may be short and low, intended for child's play as found on some playgrounds. Longer and higher rides have become popular amusement rides and vacation activities. After the rider reaches the bottom end of the zip line cable the trolley must be returned to the top.

The trolley return has been accomplished by several means. In simple low to the ground installations the return can be done by simply pushing the trolley back to the top of the cable on foot. The return has also been carried out with a line leading from the trolley to the uphill end of the line. In other installations the trolley is removed from the zip line and transported in some manner back to the top of the ride. It is known in the art that returning a zip line trolley to the starting, or elevated, point along a cable is the most challenging and most time-consuming part of a zip line's operation. Generally, a trolley is disconnected at the end, carried back up to the high point, and reconnected to the cable. Otherwise, the trolley is pulled to the elevated position of the cable using a drag line or separate retrieval device.

Other proposals have involved zipline trolleys. The problem with these trolleys is that they do not automatically return to the high point. Also, the trolleys do not have the capacity to be controlled remotely. Even though the above cited zipline trolleys meet some of the needs of the market, a zip line trolley assembly having a vehicle that rides a suspended cable and is powered by a remote-controlled drive wheel that disengages the cable when a load is carried, such that the vehicle rides freely from a high point to a low point on the cable; and the drive wheel re-engages the cable when the load is removed to enable motor-powered propulsion of the vehicle from the low point to the high point of the cable, is still desired.

SUMMARY

Illustrative embodiments of the disclosure are generally directed to an auto-return zip line trolley. The auto-return zip line trolley assembly provides a vehicle that rides a suspended cable between a low point and a high point. The vehicle is urged along the cable by a remote-controlled drive wheel. A motor drives the drive wheel to roll along the cable, when engaged. When a load is applied to the vehicle, a spring-loaded sheave subassembly urges the cable away from the drive wheel, such that the vehicle rides freely from a high point to a low point on the cable. When the load is removed from the vehicle, the spring-loaded sheave subassembly urges the cable into engagement with the drive wheel to enable motor-powered propulsion of the vehicle from the low point to the high point of the cable.

In one aspect, the auto-return zip line trolley assembly, comprises:

- a vehicle having:
  - a housing comprising multiple sidewalls, the sidewalls defining an interior cavity, a front end, and a rear end, the housing further defining a slot extending along the longitudinal of the sidewalls, the slot being sized and dimensioned to enable introduction of a cable extending between a high point and a low point into the interior cavity;
  - a drive wheel disposed inside the interior cavity of the housing, the drive wheel selectively engaged with the cable;
  - a motor operatively connected to the drive wheel, the motor configured to rotatably drive the drive wheel;
  - whereby the drive wheel drives the housing along the cable when engaged with the cable;
  - a spring-loaded sheave subassembly disposed inside the interior cavity of the housing,
  - the spring-loaded sheave subassembly comprising a front sheave, the front sheave configured to engage the cable, the front sheave further being configured to pivot between an engage position for urging the cable into engagement with the drive wheel, and a disengage position for urging the cable into disengagement from the drive wheel,
  - the front sheave subassembly further comprising a fulcrum about which the front sheave pivots between the engage position and the disengage position,
  - the front sheave subassembly further comprising a spring, the spring having a spring tension sufficient to bias the front sheave to pivot to the engage position;
- whereby in the engage position, the motor rotates the drive wheel to urge the housing along the cable;
- whereby, a load applied to the housing having a weight greater than the spring tension urges the front sheave to pivot to the disengage position; and
- whereby in the disengage position, the cable disengages from the drive wheel, causing the housing to freely ride along the cable.

In another aspect, the front sheave is configured to engage a lower end of the cable.

In another aspect, the front sheave pivots upwardly to urge the cable to the disengage position.

In another aspect, the front sheave pivots downwardly to urge the cable to the engaged position.

In another aspect, the front sheave subassembly further comprises a lever configured to join the front sheave to the spring.

In another aspect, the front sheave disposed at or near the front end of the housing in a spaced-apart and colinear relationship to the rear sheave.

In another aspect, the assembly further comprises a rear sheave disposed inside the interior cavity of the housing, the rear sheave further being disposed at or near the rear end of the housing, the rear sheave configured to constantly engage the cable for enhancing stability of the vehicle along the cable.

In another aspect, the assembly further comprises a tension control member operatively attached to the drive wheel, the tension control member configured to regulate contact pressure between the drive wheel and the cable.

In another aspect, the tension control member comprises a dial.

In another aspect, the assembly further comprises a rechargeable battery operatively connected to the motor, the rechargeable battery configured to provide electrical power to the motor.

In another aspect, the assembly further comprises a receiver disposed inside the interior cavity of the housing, the receiver being in operational communication with the motor.

In another aspect, the assembly further comprises a transmitter configured to transmit a control signal to the receiver, the control signal operable to regulate powering on and off the motor, the control signal further being operable to regulate speed of the motor.

In another aspect, the cable comprises a suspended zip line.

In another aspect, the motor is an electrical motor.

In another aspect, the motor comprises an electronic speed controller.

In another aspect, the drive wheel comprises a rubber material.

In another aspect, the assembly further comprises a pair of handles on each side of the housing.

In another aspect, the assembly further comprises a clip-in point configured to enable attachment with the load.

In another aspect, the load includes at least one of the following: a seat, a harness, and a rider.

In another aspect, the assembly further comprises a guard rail affixed to the top of the housing for at least partially covering the front and rear sheaves.

One objective of the present invention is to automate the return of a trolley along a zip line through a motorized drive wheel that disengages to roll freely downhill and engages for motorized propulsion of the vehicle uphill.

Another objective is to provide faster operation of the vehicle for immediate return uphill after the rider detaches from the vehicle.

Yet another objective is to provide a smoother ride along suspended cables, because drag lines are prone to tangling and snagging during operation.

Another objective is to provide a safer operation by avoiding a tangled drag line that is a hazard to participants, i.e., entanglement, sudden stops. And the permanent fixing of the vehicle on the cable reduces equipment changes and room for operator error.

Another objective is to provide a zip line vehicle that is useful in carrying a rider over-water installation, where the sudden release of the participant tends to bounce and spin the vehicle, tangling any drag line attached and derailing the vehicle wheels.

Another objective is to enable adjustment of the tension between drive wheel and cable to accommodate variously sized and diameter suspended cables/zip lines.

Another objective is to remotely control the motorized ascension of the vehicle.

Another objective is to provide an inexpensive to operate auto-return zip line vehicle assembly.

Other assemblies, devices, methods, features, and advantages will be or become apparent to one with skill in the art upon examination of the following drawings and detailed description. It is intended that all such additional assemblies, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 4A shows the front sheave in a disengage position, and FIG. 4B shows the front sheave in an engage position, in accordance with an embodiment of the present invention;

Like reference numerals refer to like parts throughout the various views of the drawings.

DETAILED DESCRIPTION OF THE INVENTION

Figure 1:
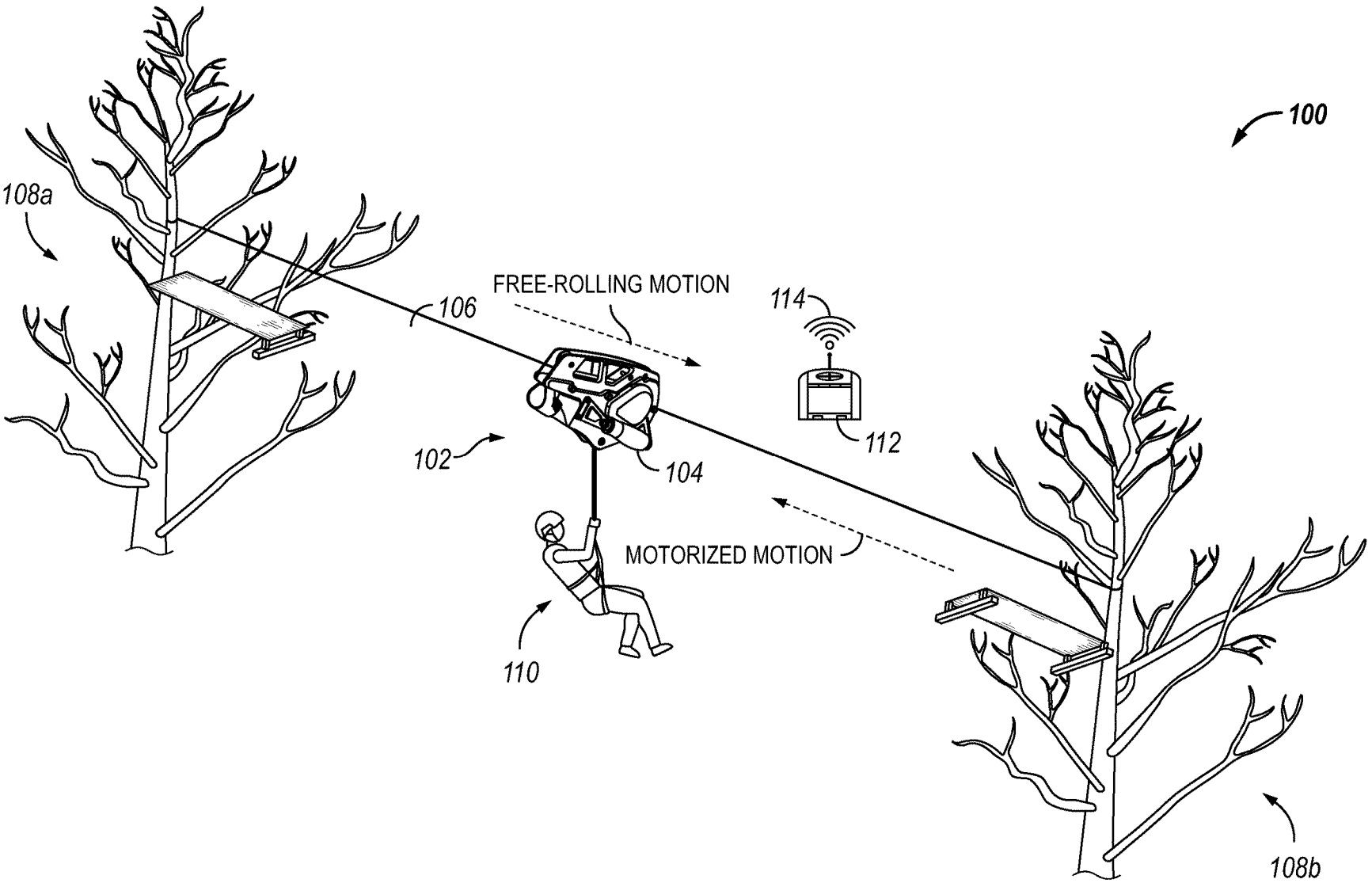
FIG. 1 illustrates a block diagram of an exemplary auto-return zip line trolley assembly, showing a vehicle traveling along a suspended cable between a high point and a low point, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, summary, or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting unless the claims expressly state otherwise.

An auto-return zip line trolley assembly 100 is referenced in FIGS. 1-6. The auto-return zip line trolley assembly 100, hereafter "assembly 100" enables automated, remote-controlled travel of a vehicle 102, such as a zipline trolley, between a high point 108*a* and a low point 108*b* of a cable 106. Such a vehicle 102 is configured to safely carry a load 110, such as a rider via a handlebar, a harness, or seat, atop a suspended zipline cable 106 from one end of the zipline to the other. The vehicle 102 can have, incorporated therein, a drive wheel 408 and multiple sheaves. The present disclosure automates engagement and disengagement of the drive wheel 408 with the cable 106, to selectively enable either free rolling, or motorized driving of the vehicle 102, depending on whether a load 110 is attached thereto, and whether the vehicle 102 is at the low point 108*b* or the high point 108*a* of the cable 106.

For example, FIG. 1 illustrates a perspective view of the assembly 100 traveling along a suspended cable between a high point and a low point. As illustrated, the vehicle 102 rolls freely from the high point 108*a* to the low point 108*b* with a load 110 attached. This is possible because gravity provides the impetus for driving the vehicle 102 along the cable 106. The same vehicle 102 is shown travelling uphill under motor power, from the low point 108*b* to the high point 108*a* when the load 110 is removed. In this operational embodiment, a motor-powered drive wheel 408 engages the cable 106 to drive the vehicle 102 against the force of gravity and while carrying the load 110. The mechanisms that enable such automated operation of the vehicle 102 are disclosed below.

Figure 2:
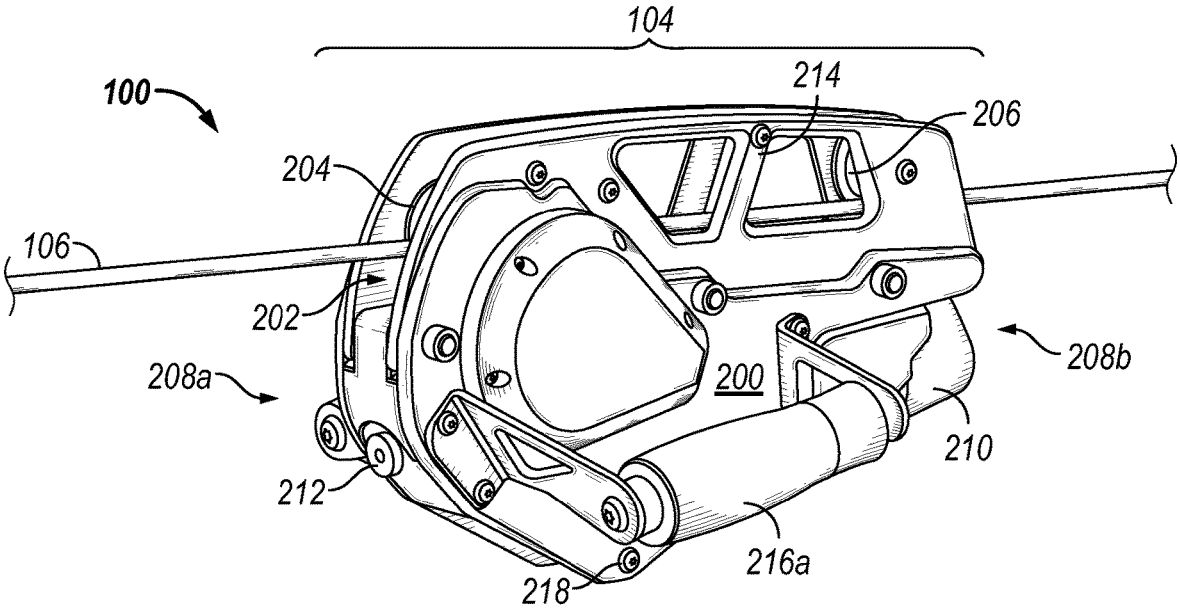
FIG. 2 illustrates a rear perspective view of an exemplary auto-return zip line trolley assembly, in accordance with an embodiment of the present invention.

As FIG. 2 illustrates, the vehicle 102 comprises a housing 104 that forms a protective shell around the mechanical and electrical components of the assembly 100. The housing 104 comprises multiple sidewalls 200, which can include panels that form a generally rectangular, elongated shape. In other embodiments, the housing 104 can have a bullet shaped configuration for aerodynamic traversing up and down the cable 106. In other embodiments, the sidewalls 200 can take additional shapes, including cubicle, pyramid, and irregular shapes. In other embodiments, the sidewalls 200 define an interior cavity into which the mechanical and electrical components reside (See FIG. 4A). The housing 104 has a front end 208*a*, and an opposing rear end 208*b*. Because the housing 104 is simply moving linearly along a cable 106, the forward and rearward orientation is relative.

Figure 3:
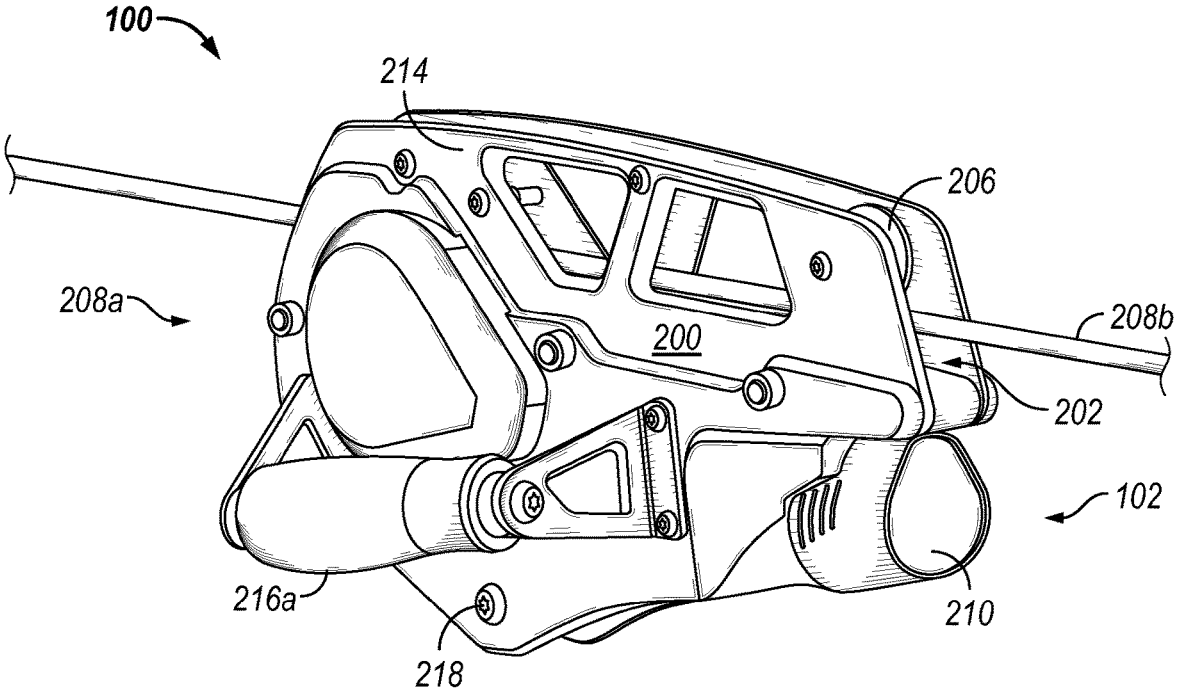
FIG. 3 illustrates a front perspective view of the auto-return zip line trolley assembly shown in FIG. 2, in accordance with an embodiment of the present invention.

As referenced in FIG. 3, the housing 104 also defines a slot 202 that extends along the longitudinal of the sidewalls 200. The slot 202 is sized and dimensioned to enable introduction of a cable 106 in a central region of the interior cavity. The cable 106 can extend between a high point 108*a* and a low point 108*b*. In other embodiments, the slot 202 may orient upwardly, such that the cable 106 slides downwardly into the interior cavity. In some embodiments, the cable 106 is a suspended zip line, as is used in a mountain lift.

In some embodiments, the assembly further comprises a guard rail affixed to the top of the housing 104 for at least partially covering the front and rear sheave 206*s*. The guard rail protects the sheaves from physical damage and serves to help align the housing 104 with the cable 106. The guard rails 214 may include a pair of parallel, flat plates projecting from both sides of the slot 202 in the housing 104. In one possible embodiment, the assembly 100 further comprises a pair of handles 216*a-b* on each side of the housing 104. The handles 216*a-b* enable the load 110, such as a rider, to attach to the housing 104 while free rolling downhill, from the high point 108*a* to the low point 108*b*.

As FIG. 2 illustrates, other anchoring mechanisms can be located, however, on the housing 104, to enable tying or clipping the load 110 directly to the housing 104. For example, the assembly 100 also utilizes a clip-in point 218 at each side of the housing 104. The clip-in point 218 is configured to enable attachment with a seat, a harness, and the pair of handles 216*a-b*. The clip-in point may be a screw or bolt that fastens the seat, harness, or handles 216*a-b* to the housing 104.

Figure 4A:
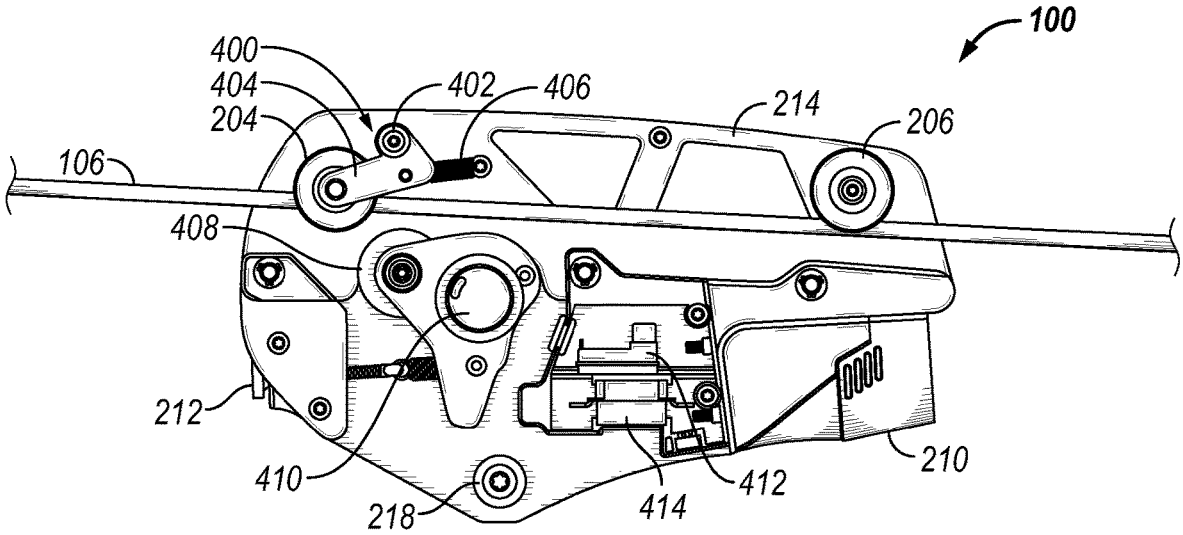
FIGS. 4A-4B illustrates a sectioned side view of the auto-return zip line trolley assembly, where

Looking now at FIG. 4A, the assembly 100 also includes a drive wheel 408 that is operational inside the interior cavity of the housing 104. The drive wheel 408 selectively engages a lower end of the cable 106. In one non-limiting embodiment, the drive wheel 408 comprises a rubber material to enhance traction with the cable 106. In this configuration, the drive wheel 408 may be a disc with rubber layers to enhance traction with the cable 106. Any friction enhancing material may however be used in construction of the drive wheel 408. Thus, as the drive wheel 408 rotates, the housing 104 is urged to move in the same direction as the rotation of the drive wheel 408. Conversely, when the drive wheel 408 and cable 106 are disengaged, the vehicle 102 moves freely along the cable 106, from the high point 108*a* to the low point 108*b*.

In this manner, the drive wheel 408 rides the lower side of the cable 106, creating traction therebetween. This enables the drive wheel 408 to propel the entire housing 104 along the cable 106; even while the housing 104 carries a load 110. It is significant to note that the uphill return of the load 110 on the housing 104 is distinct from the downhill load 110. In any case, the housing 104 is configured to return a small load 110, such as an empty bucket swing or disc seat, from the low point 108*b* to the high point 108*a* of the cable 106.

The drive wheel 408 is regulated to selectively engage and disengage the cable 106. When the housing 104 carries a load 110, the weight of the load 110 causes the cable 106 to disengage from the drive wheel 408 (See FIG. 4A). This allows the drive wheel 408 to roll freely from a high point 108*a* to a low point 108*b* on the cable 106. Once at the low point 108*b*, the load 110 is removed from the housing 104, causing the drive wheel 408 to re-engage the cable 106 (See FIG. 4B). The allows the motor-powered drive wheel 408 to urge the housing 104 towards the high point 108*a* of the cable 106.

As discussed above, once the drive wheel 408 engages with the cable 106, a motor 410 propels the drive wheel 408 to drive the housing 104 from the low point 108*b* to the high point 108*a* along the cable 106. In one possible embodiment, the motor 410 is operatively connected to the drive wheel 408 to rotatably drive the drive wheel 408. In some embodiments, the motor 410 is an electrical motor 410. In other embodiments, the motor 410 comprises an electronic speed controller 414; and thereby the speed that the housing 104 moves uphill along the cable 106. In this manner, the drive wheel 408 drives the housing 104 along the cable 106 when engaged with the cable 106; thereby automating the movement of the housing 104 along the cable 106.

Figure 4B:
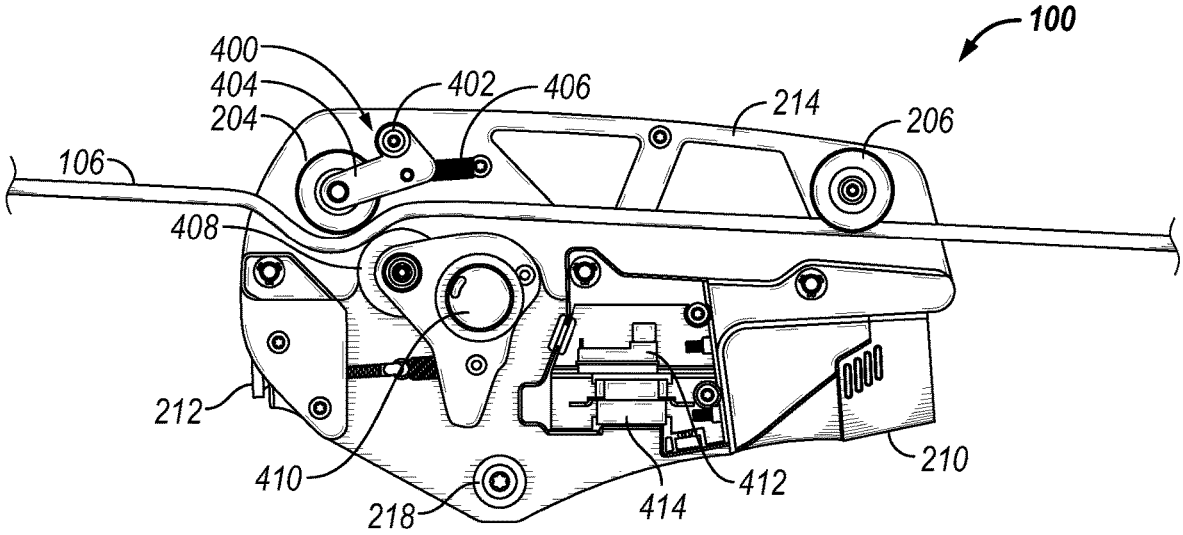
Figure 5:
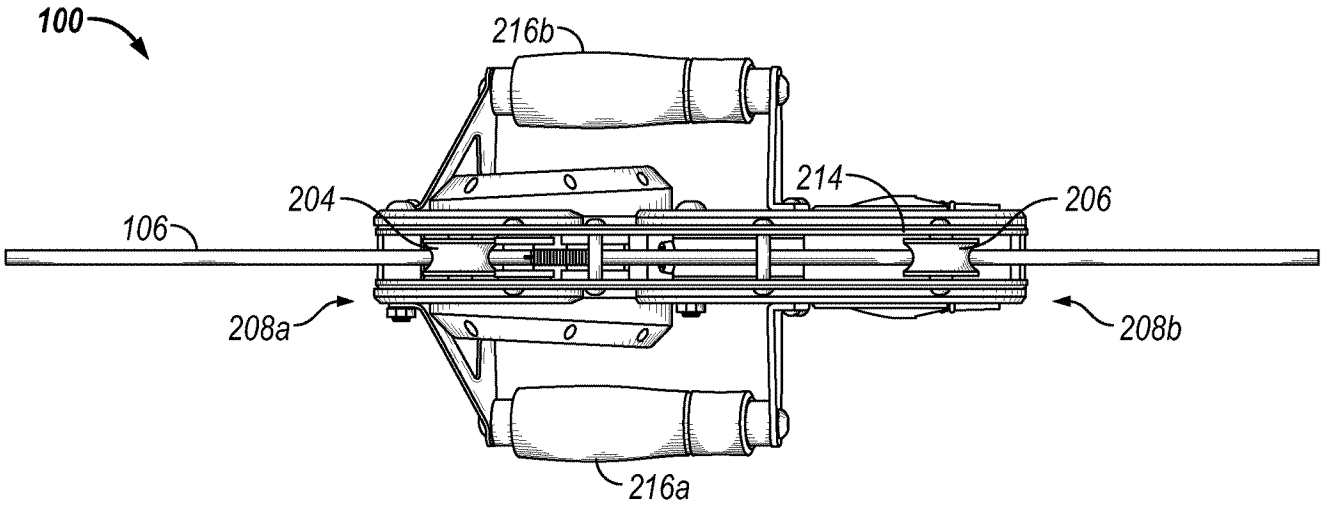
FIG. 5 illustrates a top view of the vehicle of the auto-return zip line trolley assembly shown in FIG. 2, in accordance with an embodiment of the present invention.

As referenced in FIG. 4B, the assembly 100 includes a spring-loaded sheave subassembly 400. The sheave subassembly 400 is the mechanism that enables selective engagement between the cable 106 and the drive wheel 408. In some embodiments, the sheave subassembly 400 is operationally disposed inside the interior cavity of the housing 104. In some embodiments, the spring-loaded sheave subassembly 400 comprises a front sheave 204 that is configured to engage a lower end of the cable 106. This allows the front sheave 204 to selectively lift and lower the cable 106 into contact with the drive wheel 408. In some embodiments, the front sheave 204 is disposed at or near the front end 208*a* of the housing 104.

In this manner, the front sheave 204 pivots between an engage position that urges the cable 106 into engagement with the drive wheel 408. In one embodiment, the front sheave 204 pivots downwardly to urge the cable 106 to the engage position. Conversely, the front sheave 204 pivots to a disengage position that urges the cable 106 to disengage from the drive wheel 408. In one possible embodiment, the front sheave 204 pivots upwardly to urge the cable 106 to the disengage position.

To enable this mechanism, the front sheave 204 subassembly 400 includes a fulcrum 402 about which the front sheave 204 pivots between the engage position and the disengage position. The fulcrum 402 may include a bolt or screw. Furthermore, the front sheave 204 subassembly 400 comprises a spring 406 that is operatively connected to the front sheave 204 and works to bias the front sheave 204 to the engage position. As referenced in FIG. 5, the front sheave 204 subassembly 400 further comprises a lever 404 that is configured to join the front sheave 204 to the spring 406. The lever 404 may include a flat bar, having an L-shaped configuration.

In other embodiments, the spring 406 has a spring tension that is sufficient to bias the front sheave 204 to pivot to the engage position. In some embodiments, the spring comprises a compression spring, or an extension spring. Thus, in the engage position where the cable 106 and the drive wheel 408 are in contact, the motor rotates the drive wheel 408 to urge the housing 104 along the cable 106. When the load 110 is removed from the housing 104, the front sheave 204 is pivoted to the engage position.

Conversely, in the disengage position, the cable 106 disengages from the drive wheel 408, causing the housing 104 to freely ride along the cable 106. When the weight of the load 110 is sufficient, such as a rider or a ski chair, the weight of the load 110 overcomes the spring tension. In one non-limiting embodiment, the spring tension is in units of force divided by distance. In some embodiments, the load 110 includes at least one of the following: a seat, a harness, and a rider. It is possible, for example, for a rider to grip the handles 216*a-b* while the vehicle 102 travels from the high point 108*a* to the low end. In some embodiments, the housing 104 comprises a clip-in point to enable attachment with the load 110 (See FIG. 2).

Figure 6:
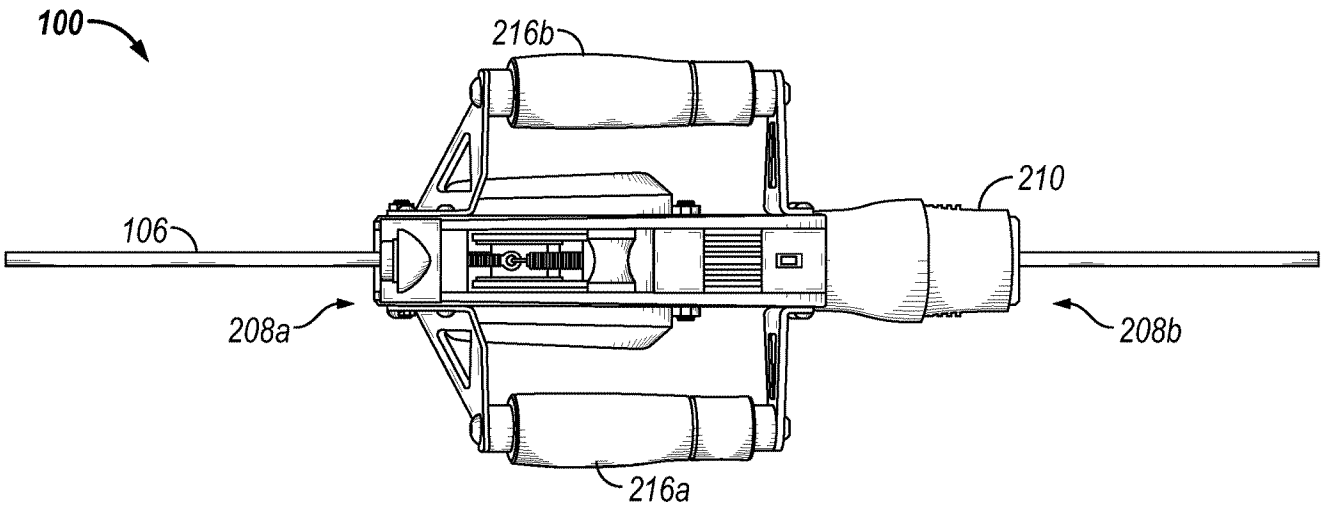
FIG. 6 illustrates a bottom view of the vehicle of the auto-return zip line trolley assembly shown in FIG. 2, in accordance with an embodiment of the present invention.

Looking again at FIG. 6, the assembly 100 further comprises a rear sheave 206 that is disposed inside the interior cavity of the housing 104. The rear sheave 206 positions at or near the rear end 208*b* of the housing 104, in a spaced-apart and colinear relationship to the front sheave 204. In one embodiment, the front and rear sheave 206*s* roll about an axle in both directions in a free-rolling manner. The rear sheave 206 is configured to constantly engage the cable 106, rolling along the lower end of the cable 106. This serves to enhance stability of the housing 104 traveling along the cable 106. Thus, the front and rear sheave 206*s* can simultaneously roll across the cable 106, from the low point 108*b* to the high point 108*a*. And the rear sheave 206 alone rolls across the cable 106, from the high point 108*a* to the low point 108*b*.

In some embodiments, the assembly further comprises a tension control member 212 that operatively attaches to the drive wheel 408. The tension control member 212 is configured to regulate contact pressure between the drive wheel 408 and the cable 106. This may be operable by urging the drive wheel 408 towards the cable 106, and away from the cable 106 in increments. In alternative embodiments, the tension control member 212 is remote controlled. In one non-limiting embodiment, the tension control member 212 comprises a dial that can be rotated in a first direction to tighten the grip between the drive wheel 408 and the cable 106, or a second direction to disengage the driver wheel from the cable 106. This tension control member 212 allows the drive wheel 408 to accommodate variously sized and dimensioned cable 106*s*.

In some embodiments, the assembly 100 further comprises a rechargeable battery 210 operatively connected to the motor. The rechargeable battery 210 is configured to provide electrical power to the motor. The rechargeable battery 210 is designed for quick connect and disconnect for optimal operation on a ski slope, for example. The rechargeable battery 210 can be recharged through an external power source, a solar panel, or another battery 210.

As FIG. 4A shows, the assembly 100 further comprises a receiver 412 disposed inside the interior cavity the housing 104, the receiver 412 being in operational communication with the motor. The receiver 412 can be operable to receive radio signals, as is commonly used in radio control. To send signals to the receiver 412, the assembly 100 comprises a transmitter 112 that is configured to transmit a control signal 114 to the receiver 412. The control signal is operable to regulate powering on and off the motor. The control signal is also operable to regulate speed of the motor, through the electronic speed controller 414. In alternative embodiments, the control signal may include, without limitation, infrared light, visible light, radio waves, or sound waves.

In operation, the vehicle 102 is controlled by a user-operated transmitter 112 and actuated by an internal motor and drive wheel 408 that is tensioned against the cable 106 for rotatable traction. Riding the cable 106 from the high point 108*a* to the low point 108*b*, the weight of the load 110 pivots the spring-loaded front sheave 204 to the disengage position, causing the drive wheel 408 to disengage from the cable 106. The front and rear sheave 206*s* roll freely, to enable the trolley to ride the cable 106 from the high point 108*a* to the low point 108*b* while carrying the load 110.

Once the load 110 disengages from the vehicle 102 at the end of the ride, the spring-loaded front sheave 204 biases to the engage position, causing the drive wheel 408 to re-engage the cable 106. Once in contact with the cable 106, the drive wheel 408 can be operatively driven by the motor, such that the vehicle 102 is driven back to the high point 108*a*. This utilization of the load 110's weight to disengage the cable 106 from the drive wheel 408 is what allows the retrieval components to be integrated into the vehicle 102 itself.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An auto-return zip line trolley assembly, the assembly comprising:

a vehicle having:

a housing comprising multiple sidewalls, the sidewalls defining an interior cavity, a front end, and a rear end, the housing further defining a slot extending along the longitudinal of the sidewalls, the slot being sized and dimensioned to enable introduction of a cable extending between a high point and a low point into the interior cavity;

a drive wheel disposed inside the interior cavity of the housing, the drive wheel selectively engaged with the cable;

a motor operatively connected to the drive wheel, the motor configured to rotatably drive the drive wheel;

whereby the drive wheel drives the housing along the cable when engaged with the cable;

a spring-loaded sheave subassembly disposed inside the interior cavity of the housing, the spring-loaded sheave subassembly comprising a front sheave, the front sheave configured to engage the cable, the front sheave further being configured to pivot between an engage position for urging the cable into engagement with the drive wheel, and a disengage position for urging the cable into disengagement from the drive wheel, the front sheave subassembly further comprising a fulcrum about which the front sheave pivots between the engage position and the disengage position, the front sheave subassembly further comprising a spring, the spring having a spring tension sufficient to bias the front sheave to pivot to the engage position;

whereby in the engage position, the motor rotates the drive wheel to urge the housing along the cable;

whereby, a load applied to the housing having a weight greater than the spring tension urges the front sheave to pivot to the disengage position; and whereby in the disengage position, the cable disengages from the drive wheel, causing the housing to freely ride along the cable.

2. The assembly of claim 1, wherein the front sheave is configured to engage a lower end of the cable.

3. The assembly of claim 2, wherein the front sheave pivots upwardly to urge the cable to the disengage position.

4. The assembly of claim 3, wherein the front sheave pivots downwardly to urge the cable to the engage position.

5. The assembly of claim 1, wherein the front sheave subassembly further comprises a lever configured to join the front sheave to the spring.

6. The assembly of claim 1, further comprises a rear sheave disposed inside the interior cavity of the housing, the rear sheave further being disposed at or near the rear end of the housing in a spaced-apart and colinear relationship to the front sheave, the rear sheave configured to constantly engage the cable.

7. The assembly of claim 1, further comprising a tension control member operatively attached to the drive wheel, the tension control member configured to regulate contact pressure between the drive wheel and the cable, the tension control member comprising a dial.

8. The assembly of claim 1, further comprising a rechargeable battery operatively connected to the motor, the rechargeable battery configured to provide electrical power to the motor.

9. The assembly of claim 1, further comprising a receiver disposed inside the interior cavity of the housing, the receiver being in operational communication with the motor.

10. The assembly of claim 9, further comprising a transmitter configured to transmit a control signal to the receiver, the control signal operable to regulate powering on and off the motor, the control signal further being operable to regulate speed of the motor.

11. The assembly of claim 1, wherein the motor comprises an electrical motor and an electronic speed controller.

12. The assembly of claim 1, wherein the drive wheel comprises a rubber material.

13. The assembly of claim 1, wherein the cable comprises a suspended zip line.

14. The assembly of claim 1, further comprising a pair of handles opposing sides of the housing.

15. The assembly of claim 1, further comprising a clip-in point configured to enable attachment to the load.

16. The assembly of claim 1, further comprising a guard rail affixed to the top of the housing for at least partially covering the front and rear sheaves.

17. An auto-return zip line trolley assembly, the assembly comprising:

a vehicle having:

a housing comprising multiple sidewalls, the sidewalls defining an interior cavity, a front end, and a rear end, the housing further defining a slot extending along the longitudinal of the sidewalls, the slot being sized and dimensioned to enable introduction of a cable extending between a high point and a low point into the interior cavity;

a drive wheel disposed inside the interior cavity of the housing, the drive wheel selectively engaged with the cable;

a tension control member operatively attached to the drive wheel, the tension control member configured to regulate contact pressure between the drive wheel and the cable, the tension control member comprising a dial;

a motor operatively connected to the drive wheel, the motor configured to rotatably drive the drive wheel;

whereby the drive wheel drives the housing along the cable when engaged with the cable;

a spring-loaded sheave subassembly disposed inside the interior cavity of the housing, the spring-loaded sheave subassembly comprising a front sheave, the front sheave configured to engage a lower end of the cable, the front sheave further being configured to pivot between an engage position for urging the cable into engagement with the drive wheel, and a disengage position for urging the cable into disengagement from the drive wheel, the front sheave subassembly further comprising a fulcrum about which the front sheave pivots between the engage position and the disengage position, the front sheave pivoting upwardly to urge the cable to the disengage position, the front sheave pivoting downwardly to urge the cable to the engage position, the front sheave subassembly further comprising a spring, the spring having a spring tension sufficient to bias the front sheave to pivot to the engage position;

whereby in the engage position, the motor rotates the drive wheel to urge the housing along the cable;

whereby, a load applied to the housing having a weight greater than the spring tension urges the front sheave to pivot to the disengage position;

whereby in the disengage position, the cable disengages from the drive wheel, causing the housing to freely ride along the cable;

a receiver disposed inside the interior cavity the housing, the receiver being in operational communication with the motor; and a transmitter configured to transmit a control signal to the receiver, the control signal operable to regulate powering on and off the motor, the control signal further being operable to regulate speed of the motor.

18. The assembly of claim 17, further comprising a rechargeable battery operatively connected to the motor, the rechargeable battery configured to provide electrical power to the motor.

19. The assembly of claim 17, further comprising a clip-in point configured to enable attachment to the load.

20. An auto-return zip line trolley assembly, the assembly consisting of:

a vehicle having:

a housing comprising multiple sidewalls, the sidewalls defining an interior cavity, a front end, and a rear end, the housing further defining a slot extending along the longitudinal of the sidewalls, the slot being sized and dimensioned to enable introduction of a cable extending between a high point and a low point into the interior cavity;

a pair of handles opposing sides of the housing;

a drive wheel disposed inside the interior cavity of the housing, the drive wheel selectively engaged with the cable;

a tension control member operatively attached to the drive wheel, the tension control member configured to regulate contact pressure between the drive wheel and the cable, the tension control member comprising a dial;

a motor operatively connected to the drive wheel, the motor configured to rotatably drive the drive wheel;

a rechargeable battery operatively connected to the motor, the rechargeable battery configured to provide electrical power to the motor;

whereby the drive wheel drives the housing along the cable when engaged with the cable;

a spring-loaded sheave subassembly disposed inside the interior cavity of the housing, the spring-loaded sheave subassembly comprising a front sheave, the front sheave configured to engage a lower end of the cable, the front sheave further being configured to pivot between an engage position for urging the cable into engagement with the drive wheel, and a disengage position for urging the cable into disengagement from the drive wheel, the front sheave subassembly further comprising a fulcrum about which the front sheave pivots between the engage position and the disengage position, the front sheave pivoting upwardly to urge the cable to the disengage position, the front sheave pivoting downwardly to urge the cable to the engage position, the front sheave subassembly further comprising a spring, the spring having a spring tension sufficient to bias the front sheave to pivot to the engage position;

whereby in the engage position, the motor rotates the drive wheel to urge the housing along the cable;

whereby, a load applied to the housing having a weight greater than the spring tension urges the front sheave to pivot to the disengage position;

whereby in the disengage position, the cable disengages from the drive wheel, causing the housing to freely ride along the cable;

a receiver disposed inside the interior cavity the housing, the receiver being in operational communication with the motor;

a transmitter configured to transmit a control signal to the receiver, the control signal operable to regulate powering on and off the motor, the control signal further being operable to regulate speed of the motor; and a clip-in point configured to enable attachment to the load.

* * * * *